US009506248B1

(12) United States Patent
Fields et al.

(10) Patent No.: US 9,506,248 B1
(45) Date of Patent: Nov. 29, 2016

(54) MODULAR PLATFORM

(71) Applicant: OUTDOOR VENTURE CORPORATION, Stearns, KY (US)

(72) Inventors: Joseph W. Fields, Oneida, TN (US); Brian Lee Maxwell, Stearns, KY (US); Anthony R. Hines, Science Hill, KY (US); Steven C. Chitwood, Whitley City, KY (US)

(73) Assignee: OUTDOOR VENTURE CORPORATION, Stearns, KY (US)

( * ) Notice: Subject to any disclaimer, the term of this patent is extended or adjusted under 35 U.S.C. 154(b) by 0 days.

(21) Appl. No.: 15/041,735

(22) Filed: Feb. 11, 2016

Related U.S. Application Data

(60) Provisional application No. 62/115,305, filed on Feb. 12, 2015.

(51) Int. Cl.
*E04B 5/00* (2006.01)
*E04B 5/02* (2006.01)
*E04B 5/10* (2006.01)

(52) U.S. Cl.
CPC *E04B 5/023* (2013.01); *E04B 5/10* (2013.01)

(58) Field of Classification Search
CPC ..... E04B 5/023; E04B 5/10; E04B 5/14; E04B 9/064; E04B 9/10; E04B 9/12; E04B 9/127; E04B 2/7836; E04C 3/02; E04C 3/04; E04C 3/0404; E04C 3/28
USPC ..... 52/261, 272, 275, 279, 281, 282.1, 52/282.2, 283, 843, 844, 845, 846
See application file for complete search history.

(56) References Cited

U.S. PATENT DOCUMENTS 3,603,054 A * 9/1971 Didry ..... E04B 2/7854 52/280
3,820,299 A * 6/1974 Verholt ..... A47B 96/1466 312/330.1
4,493,428 A * 1/1985 Mittelmann ..... B65D 88/14 220/1.5
4,730,428 A * 3/1988 Head ..... E04B 5/026 52/309.11
5,109,998 A * 5/1992 Bretschneider ..... B65D 90/021 220/1.5
6,003,279 A * 12/1999 Schneider ..... E04B 1/0046 403/230

* cited by examiner

*Primary Examiner* — Patrick Maestri
(74) *Attorney, Agent, or Firm* — J.M. Robertson, LLC

(57) ABSTRACT

A modular platform including a multiplicity of elongate interior frame members and elongate perimeter frame members forming a grid frame adapted to receive floor panels within interstitial zones. The modular platform may be elevated relative to the underlying ground to provide a level support surface even if the ground is not level. The modular platform is adapted to accommodate solid walls if a semi-permanent or permanent structure is desired. The platform may be easily assembled in various sizes and may be disassembled for reuse.

20 Claims, 6 Drawing Sheets

MODULAR PLATFORM

CROSS REFERENCE TO RELATED APPLICATION(S)

This non-provisional application claims the benefit of, and priority from, U.S. provisional patent application No. 62/115,305 having a filing date of Feb. 12, 2015. The contents of such priority application are hereby incorporated by reference in their entirety as if fully set forth herein.

TECHNICAL FIELD

The present disclosure relates generally to temporary structures, and more specifically to a modular platform adapted to support a tent in raised relation to the ground for temporary shelter and further adapted to accommodate solid walls if a semi-permanent or permanent structure is desired. Such a modular platform may likewise have application in other environments of use such as sidewalks, decks and other platforms as may be desired.

BACKGROUND

The use of soft-walled tents for shelter is well known. Such structures provide the benefits of light weight and portability which facilitate their use as mobile, temporary structures. In some instances, it may be necessary to use a tent for a prolonged period of time. In such circumstances, it may be desirable for the tent to exhibit characteristics of a more permanent structure to provide the user with a greater degree of comfort and security. Moreover, in some instances it may be desirable to replace a temporary tent structure with a semi-permanent or permanent wall structure for longer periods of use.

In the past, it was known to use a wooden plank arrangement to form a platform for use in supporting a tent and for other uses. Moreover, it is known to construct such wooden plank platforms in raised relation to the underlying ground in order to protect a user from moisture penetration from the ground in the event of rain. As will be appreciated, the construction of such a raised wooden platform may be time consuming and may require significant skill. Moreover, once such wooden platforms have been assembled, the components may be unsuitable for reuse. Further, such prior wooden platforms are not constructed to accommodate the erection of solid walls in the event that a semi-permanent or permanent structure is desired.

SUMMARY

The present disclosure provides advantages and alternatives over the prior art by providing a modular platform for use in various environments of use including sidewalks, decks, and support for a tent or walled structure. Of course, such uses are merely exemplary and the modular platform may likewise find application in other environments of use. The modular platform may be elevated relative to the underlying ground to provide a level support surface even if the ground is not level. The modular platform is also adapted to accommodate solid walls if a semi-permanent or permanent structure is desired. The platform may be easily disassembled for reuse.

In accordance with one exemplary aspect, the present disclosure provides a modular flooring platform which can be disassembled for reuse. The modular flooring platform includes a plurality of elongate interior frame members. The interior frame members include a substantially hollow tubular body portion defining a hollow interior. The interior frame members may each including a pair of lateral ledge elements defining substantially flat fins projecting away from opposing sides of the hollow tubular body portion at a common, defined elevation. The modular flooring platform further includes a plurality of elongate perimeter frame members. The perimeter frame members include a substantially hollow tubular body portion defining a hollow interior. The perimeter frame members may each include an inboard lateral edge element defining a substantially flat fin projecting away from a first side of the hollow tubular body and an outboard lateral ledge element projecting away from a second side of the hollow tubular body. The outboard lateral ledge defines a raised lip spaced apart from the hollow tubular body portion of the perimeter frame member. The modular flooring platform further includes a plurality of angle-forming connection elements. Each angle-forming connection element includes a plurality of hollow tubular legs projecting away from an intersection such that at least two of the hollow tubular legs are in angled relation to one another. The hollow tubular legs are adapted to slide in telescoping relation into the hollow tubular body portions of the interior frame members and the perimeter frame members. The interior frame members, perimeter frame members and angle-forming connection elements are connectable to form a grid frame having a perimeter channel formed by the outboard lateral ledge elements. The formed grid includes a plurality of interstices at least partially surrounded by interior frame members at locations inboard from the perimeter channel. A plurality of removable floor panels are adapted to fit in nested relation within the interstices to define a supporting flooring surface.

Other features and advantages of the invention will become apparent to those of skill in the art upon review of the following detailed description, claims and drawings.

Figure 1:
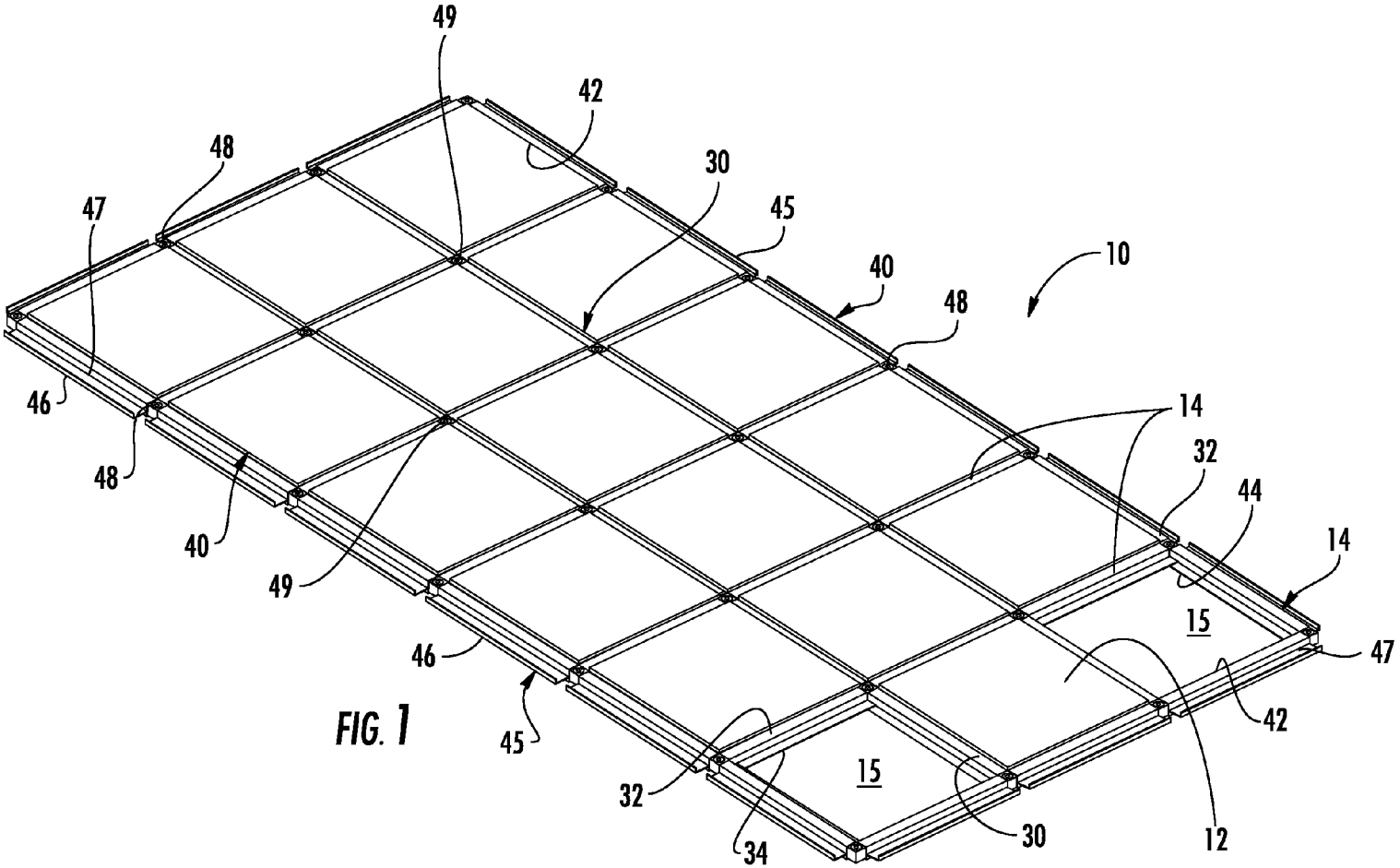
FIG. 1 illustrates an exemplary modular platform consistent with the present disclosure.

Before the exemplary embodiments of the invention are explained in detail, it is to be understood that the invention is in no way limited in its application or construction to the details and the arrangements of the components set forth in the following description or illustrated in the drawings. Rather, the invention is capable of other embodiments and being practiced or being carried out in various ways.

DETAILED DESCRIPTION OF THE PREFERRED EMBODIMENTS

Reference will now be made to the drawings, wherein to the extent possible, like elements are designated by like reference numerals in the various views. In FIG. 1 an exemplary modular platform 10 consistent with the present disclosure is illustrated. As illustrated, the modular platform 10 defines a grid of floor panels 12 supported in nested relation within a grid frame 14. In this regard, the grid frame 14 may be formed from an interconnected arrangement of tubular structural members formed from steel, aluminum, carbon fiber composites, or other suitable structural materials as may be desired.

As shown, the individual floor panels 12 are sized and shaped to fit in drop-in nested relation within the interstitial zones 15 between the frame members in the grid frame 14. In this regard, the floor panels 12 may be substantially square as shown. However, it is likewise contemplated that other geometries such as triangles, rectangles, pentagons, hexagons and the like may be used if the grid frame is altered. By way of example only and not limitation, one suitable material for the floor panels 12 is a load bearing structural insulated panel having a galvanized steel skin over a dense polyurethane core. One such material is marketed under the trade designation IPANEL® by Outdoor Venture Corporation having a place of business in Stearns, Ky., USA. Of course, the present invention is in no way limited to any particular panel material and other insulated or non-insulated materials may likewise be used to form the floor panels 12 if desired. As will be appreciated, in FIG. 1, in order to facilitate understanding of the present disclosure, the grid frame 14 is illustrated with several empty interstitial zones 15 adapted for acceptance of floor panels 12.

Figure 2:
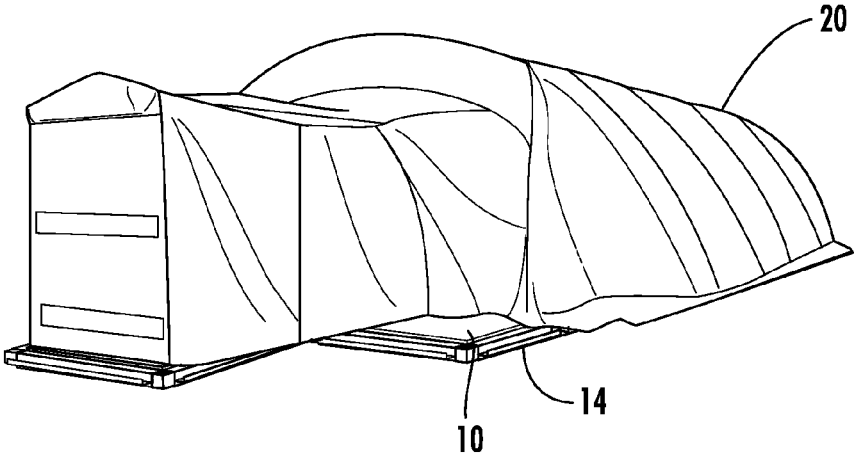
FIG. 2 illustrates an exemplary modular platform consistent with the present disclosure in underlying supporting relation to a soft-sided tent.

Referring now to FIG. 2, it may be seen that following the assembly and leveling of the platform 10, a soft sided tent 20 may be erected on the surface of the platform 10 using support lines anchored to the surrounding ground. In this arrangement, the tent 20 is spaced away from the underlying ground, and the platform 10 provides a level support defining a floor for the tent 20. In this regard, it will be understood that the configuration of the tent 20 is in no way critical to the practice of the present disclosure. To the contrary, it is contemplated that virtually any tent configuration may be used.

Figure 3:
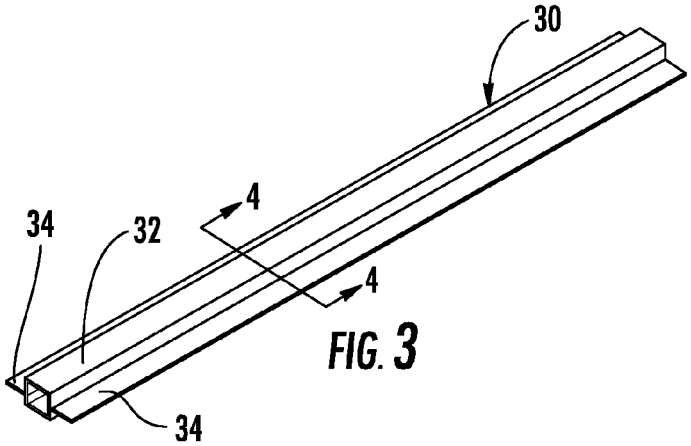
FIG. 3 is a schematic perspective view illustrating an exemplary interior frame member used in forming the frame grid of an exemplary modular platform consistent with the present disclosure.
Figure 4:
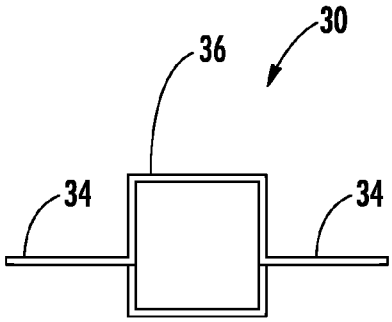
FIG. 4 is a schematic sectional view of an exemplary interior frame member used in forming the frame grid of an exemplary modular platform consistent with the present disclosure taken generally along line 4-4 in FIG. 3.

As indicated previously, in accordance with one aspect of the present disclosure, the grid frame 14 of the platform 10 may be formed from a plurality of interconnected frame members of hollow, tubular construction along their lengths. By way of example only, and not limitation, FIGS. 3 and 4 illustrate one exemplary construction for suitable interior frame members 30 for use at the interior of the grid frame 14 at positions inboard from the perimeter. As shown, the illustrated exemplary interior frame members 30 may include a box profile tubular body 32 extending substantially along the length of the interior frame members 30. In the illustrated exemplary construction, a pair of lateral ledge elements 34 extends away from opposing sides of the tubular body 32. As shown, in the exemplary construction, the lateral ledge elements 34 are positioned at the same height on opposing sides of the tubular body 32. Both of the lateral ledge elements 34 may be substantially planar so as to define generally flat fins located at substantially equal elevations on each side of the tubular body 32.

As will be appreciated, upon assembly of the grid frame 14, the lateral ledge elements 34 may provide underlying support for the floor panels 12 such that the floor panels 12 may be nested in the interstitial zones 15 between the interior frame members 30. In this arrangement, the floor panels 12 and the interior frame members 30 and upper surfaces of tubular bodies 32 cooperatively form a substantially planar upper surface. Adequate support is provided by the lateral ledge elements 34 which may project a relatively short distance of about 2 inches to about 4 inches away from the sides of the tubular body 32.

Figure 5:
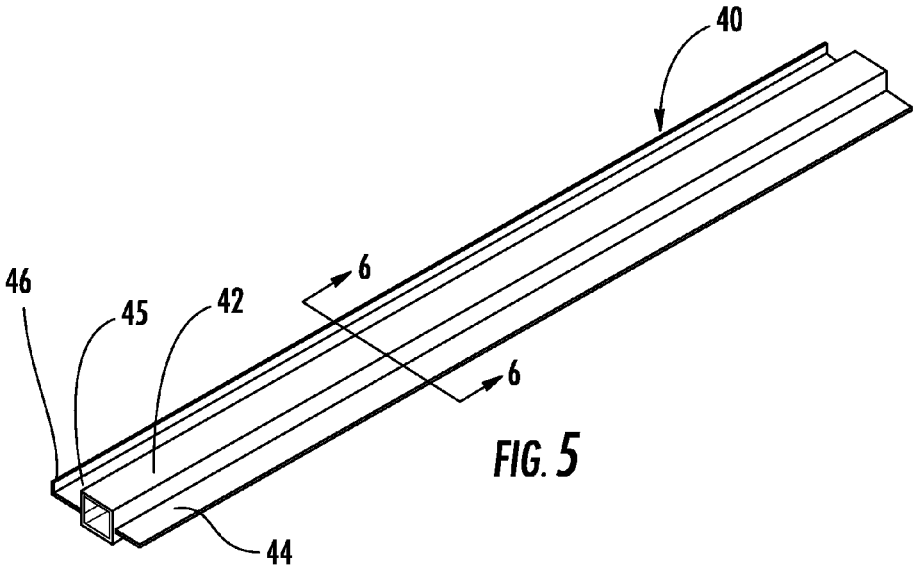
FIG. 5 is a schematic perspective view illustrating an exemplary perimeter frame member used in forming the frame grid of an exemplary modular platform consistent with the present disclosure.
Figure 6:
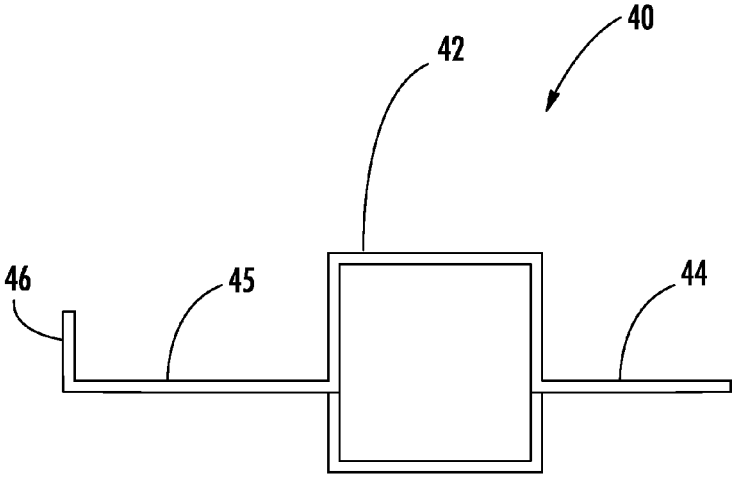
FIG. 6 is a schematic sectional view of an exemplary interior frame member used in forming the frame grid of an exemplary modular platform consistent with the present disclosure taken generally along line 6-6 in FIG. 5.

FIGS. 5 and 6 illustrate one exemplary construction for hollow tubular perimeter frame members 40 which may be used in construction of a grid frame 14 in accordance with the present disclosure. In this regard, such perimeter frame members 40 may act to cooperatively define the perimeter of an exemplary grid frame 14. As shown, in the illustrated, exemplary construction, the perimeter frame members 40 may include a hollow tubular box profile tubular body 42 extending substantially along the length of the perimeter frame members 40. A substantially planar inboard lateral ledge element 44 may extend a relatively short distance away from one side of the tubular body 42 to define a substantially flat fin.

Upon assembly of the grid frame 14, the inboard lateral ledge elements 44 projecting away from perimeter frame members 40 may cooperate with the lateral ledge elements 34 projecting away from interior frame members 30 to provide underlying support for floor panels 12 positioned at the perimeter of the platform 10 such that floor panels 12 may be nested in the interstitial zones 15 between the interior frame members 30 and the perimeter frame members 40. Adequate support is provided by the inboard lateral ledge elements 44 which may project a relatively short distance of about 2 inches to about 4 inches away from the tubular body 42.

In the illustrated exemplary construction, the perimeter frame members 40 include an outboard lateral ledge element 45 extends away from the opposing side of the tubular body 42. As shown, in the exemplary construction, the outboard lateral ledge elements 45 are substantially "L" shaped and include a raised lip 46 disposed in spaced-apart relation to the tubular body 42. The tubular body 42 and the outboard lateral ledge element 45 thereby form a perimeter channel 47 having a width and depth adequate to receive and support wall panels if desired in a manner to be described further hereinafter. As shown, the perimeter channel 47 may be discontinuous around the perimeter of the modular platform 10. However, the spaces between the perimeter segments are relatively short in length such that the perimeter channel 47 is not substantially interrupted.

The interior dimensions of the tubular body 32 of the interior frame members 30 are preferably substantially equivalent to the interior dimensions of the tubular body 42 of the perimeter frame members 40. Moreover, the lateral ledge elements 34, inboard lateral ledge elements 44 and outboard lateral ledge elements 45, may all project outwardly from the respective tubular bodies 32, 42 at a substantially common elevation. The use of such common configurations facilitates interconnection of the interior frame members 30 and the perimeter frame members 40 to form the grid frame 14.

Figure 7:
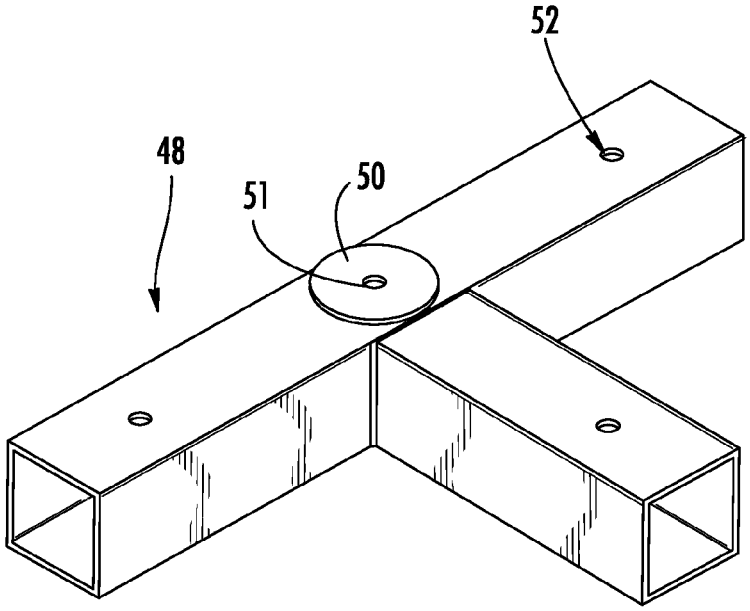
FIG. 7 is a schematic perspective view illustrating an exemplary three leg connection adapted to connect frame members together along a perimeter when forming the grid frame of an exemplary modular platform consistent with the present disclosure.
Figure 8:
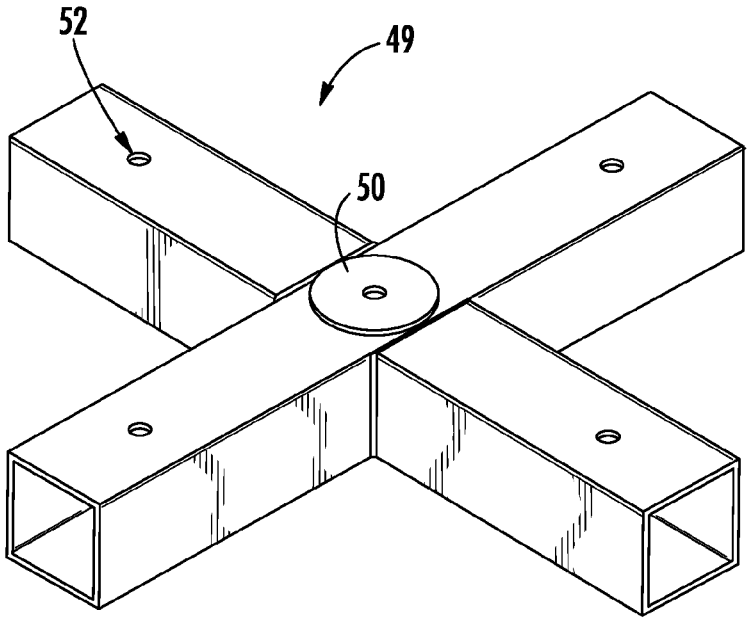
FIG. 8 is a schematic perspective view illustrating an exemplary four leg connection adapted to connect frame members together at an interior of a grid frame of an exemplary modular platform consistent with the present disclosure.

FIGS. 7 and 8 illustrate exemplary connection elements 48, 49 for use in attaching the interior frame members 30 and/or the perimeter frame members 40. As will be readily understood, the illustrated exemplary three leg connection element 48 (FIG. 7) may be formed from tubular box structures having outer perimeter dimensions slightly smaller than the inner dimensions of the tubular bodies 32, 42 of the frame members 30, 40. In use, the individual legs of the three leg connection element 48 may slide in telescoping relation into the tubular bodies 32, 42. As shown in FIG. 1, such three leg connection elements 48 may be used to form the perimeter connections of the grid frame 14. Likewise, the illustrated exemplary four leg connection element 49 (FIG. 8) may be formed from tubular box structures having outer perimeter dimensions slightly smaller than the inner dimensions of the tubular bodies 32, of the interior frame members 30 such that the individual legs of the four leg connection element may slide in telescoping relation into the tubular bodies 32 of, 42. As shown in FIG. 1, such four leg connection elements 49 may be used to form the interior connections of the grid frame 14.

Figure 9:
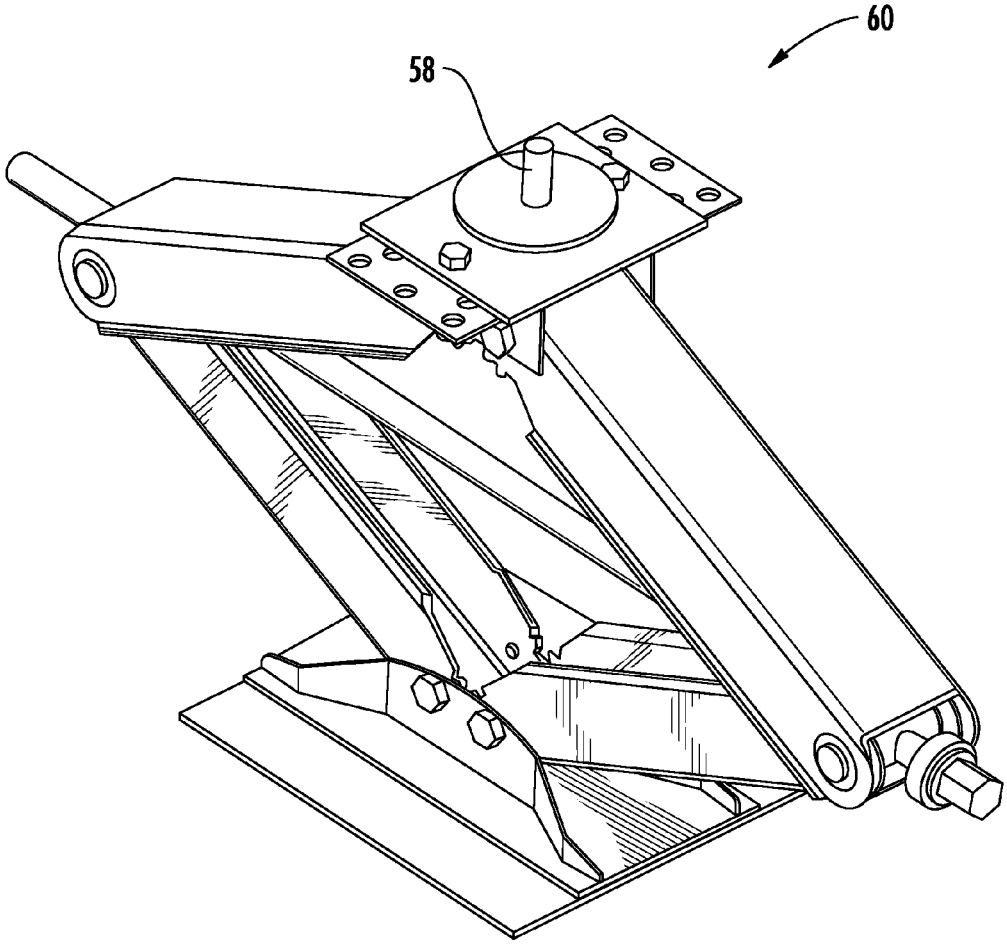
FIG. 9 illustrates an exemplary adjustable jack which may be used in combination with like devices to engage a grid frame and level a platform in accordance with the present disclosure.

As shown in FIGS. 7 and 8, in the exemplary construction, the intersection point of the connection elements 48, 49 may include a support plate 50 surrounding an opening 51 which may be used to receive an engagement stud 58 on a leveling jack 60 (FIG. 9) or other support device as may be desired. While only one surface of the connection elements 48, 49 is shown, it will be understood that support plates 50 and openings 51 may likewise be located on opposing sides as well. The connection elements 48, 49 also may include through holes with Valco clips (i.e. snap buttons) to lock into place within the interior of the frame members. Thus, the connection elements 48, 49 do not substantially interrupt the planar character of the platform surface. Moreover, the attachment can be readily reversed, thereby permitting reuse of all components.

Once the platform 10 is assembled, it may be raised away from the underlying ground and leveled by use of a plurality of leveling jacks 60 (FIG. 9) such as scissor jacks or the like placed at intersection points of frame members within the grid frame 14 and which provide underlying support. As will be appreciated, alternative leveling devices may be used to provide underlying support if desired. By way of example only, such alternative devices may include screw jacks, pneumatic levelers, hydraulic levelers, airbags and the like. As indicated previously, in accordance with one exemplary practice, leveling jacks 60 may include an outwardly projecting engagement stud 58 adapted to matedly engage a corresponding opening 51 within an opposing connection element 48, 49. As will be appreciated, through the use of multiple leveling devices, operated alone or in combination with spacer blocks (not shown), the platform 10 may be raised and leveled even if the underlying terrain is substantially irregular. As will be appreciated, a significant benefit of the platform 10 is that it can be assembled and erected substantially without the use of any tools other than a jack handle or the like during leveling.

As will be appreciated, in some environments of use it may be desirable to provide a barrier around the perimeter of the platform 10 during use. Such barriers may be useful in preventing introduction of wildlife, blowing sand or other potentially damaging forces into the space underneath the raised platform 10. By way of example only, and not limitation, one exemplary perimeter barrier may be a perimeter skirt 70 (FIG. 10) which is adapted to hook into the perimeter channel 47 at the perimeter of the raised platform 10 and hang downwardly therefrom.

Figure 10:
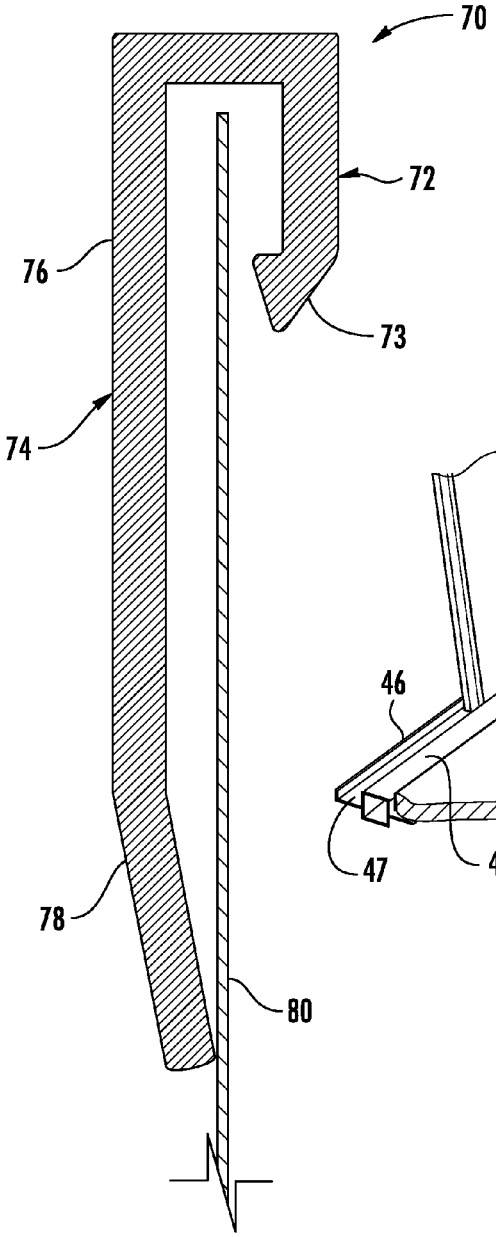
FIG. 10 is a schematic sectional view of an exemplary platform skirt which may be used at the perimeter of an exemplary modular platform consistent with the present disclosure.

Referring now to FIG. 10, one exemplary perimeter skirt 70 may incorporate a so called "J-Clip" 72 having a hooking end 73 and an elongated tail segment 74 extending downwardly away from the hooking end 72. As illustrated, the tail segment 74 may have a substantially vertical upper segment 76 intersecting a lower segment 78. As shown, the lower segment 78 may be angled inwardly generally towards the hooking end 72 to define a substantially dogleg profile. By way of example only, and not limitation, the J-Clip 72 may be formed from a structurally stable sewable material such as molded non-break polypropylene, nylon or the like having a thickness of about 0.5 inches to about 2 inches. However, other materials and/or thicknesses may likewise be used as desired. As will be appreciated, such materials are structurally stable, but may nonetheless be punctured by needles to permit attachment of other structures.

As shown, in the illustrated exemplary construction, an elongated flexible curtain member 80 of a suitable fabric or the like may be attached to the J-Clip 72 by needles or other techniques so as to form a downwardly extending pliable trim structure which may contact the ground. As will be appreciated, due to the pliable nature of the curtain member 80, irregularities in the ground surface can nonetheless be covered. If desired, weighting elements such as stones or the like may be used to hold the curtain member 80 in place against the ground following installation. Thus an effective perimeter skirting system is established.

Figure 11:
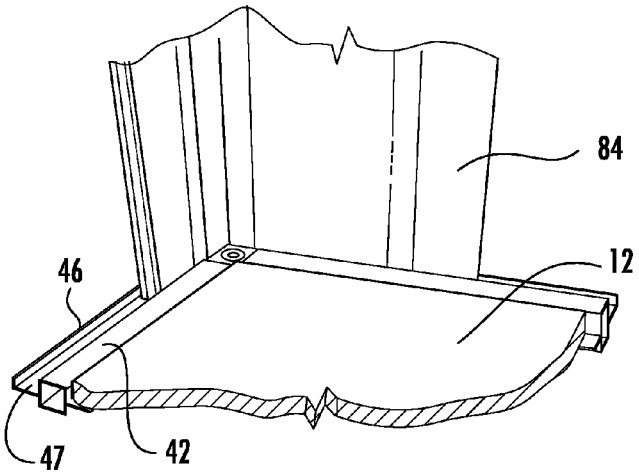
FIG. 11 is a schematic perspective view illustrating use of modular solid wall panels within an outboard perimeter channel of an exemplary modular platform consistent with the present disclosure.

As indicated previously, it is also contemplated that a platform 10 consistent with the present disclosure may be used in support of a semi-permanent or permanent structure rather than being used with a soft-sided tent. By way of example only, and not limitation, in FIG. 11, it may be seen that a platform 10 consistent with the present disclosure includes a perimeter channel 47 adapted to receive and retain wall panels 84 for use in forming a semi-permanent or permanent structure. By way of example only and not limitation, one suitable material for the wall panels 84 is the load bearing structural insulated panel having a galvanized steel skin over a dense polyurethane core which is marketed under the trade designation IPANEL® by Outdoor Venture Corporation located in Stearns, Ky., USA. Of course, the present invention is in no way limited to any particular wall panel material and other insulated or non-insulated materials may likewise be used if desired. By way of example only, and not limitation, alternative panels may include panels formed from wood, steel, aluminum plastics and the like as may be known to those of skill in the art.

Of course, variations and modifications of the foregoing are within the scope of the present disclosure. The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A modular flooring platform comprising:

a plurality of elongate interior frame members, the interior frame members having a length and comprising a substantially hollow tubular body portion defining a hollow interior, the interior frame members each including a pair of lateral ledge elements defining substantially flat fins projecting away from opposing sides of the hollow tubular body portion at a common, defined elevation;

a plurality of elongate perimeter frame members, the perimeter frame members having a length and comprising a substantially hollow tubular body portion defining a hollow interior, the perimeter frame members each including an inboard lateral edge element defining a substantially flat fin projecting away from a first side of the hollow tubular body and an outboard lateral ledge element projecting away from a second side of the hollow tubular body, the outboard lateral ledge defining a raised lip spaced apart from the hollow tubular body portion of the perimeter frame member;

a plurality of angle-forming connection elements, each angle-forming connection element comprising a plurality of hollow tubular legs projecting away from an intersection, such that at least two of the hollow tubular legs are in angled relation to one another, wherein the hollow tubular legs are adapted to slide in telescoping relation into the hollow tubular body portions of the interior frame members and the perimeter frame members, the interior frame members, perimeter frame members and angle-forming connection elements being connectable to form a grid frame having a perimeter channel formed by the outboard lateral ledge elements and a plurality of interstices at least partially surrounded by interior frame members at locations inboard from the perimeter channel; and a plurality of removable floor panels adapted to fit in nested relation within the interstices to define a supporting flooring surface.

2. The modular flooring platform as recited in claim 1, wherein the plurality of elongate interior frame members are metal.

3. The modular flooring platform as recited in claim 1, wherein the plurality of elongate interior frame members are formed from at least one of the group consisting of steel, aluminum, aluminum alloys and carbon fiber composites.

4. The modular flooring platform as recited in claim 1, wherein the plurality of elongate perimeter frame members are metal.

5. The modular flooring platform as recited in claim 1, wherein the plurality of elongate perimeter frame members are formed from at least one of the group consisting of steel, aluminum, aluminum alloys and carbon fiber composites.

6. The modular flooring platform as recited in claim 1, wherein the plurality of angle-forming connection elements are metal.

7. The modular flooring platform as recited in claim 1, wherein the plurality of angle-forming connection elements are formed from at least one of the group consisting of steel, aluminum, aluminum alloys and carbon fiber composites.

8. The modular flooring platform as recited in claim 1, wherein the removable floor panels comprise a galvanized steel skin over a polyurethane core.

9. The modular flooring platform as recited in claim 1, wherein the hollow tubular body portion of each perimeter frame member has substantially the same size and shape as the hollow tubular body portion of each interior frame member.

10. The modular flooring platform as recited in claim 9, wherein the hollow tubular body portion of each perimeter frame member is substantially square or rectangular and the hollow tubular body portion of each interior frame member is substantially square or rectangular.

11. The modular flooring platform as recited in claim 1, wherein the outboard lateral ledge element is substantially L-shaped.

12. The modular flooring platform as recited in claim 1, wherein a support plate surrounding an opening is positioned substantially at the intersection of each angle-forming connection element.

13. The modular flooring platform as recited in claim 12, wherein the opening is adapted to receive an engagement stud on a leveling support.

14. The modular flooring platform as recited in claim 1, wherein the perimeter channel is discontinuous around the grid frame.

15. The modular flooring platform as recited in claim 1, further comprising a perimeter skirt adapted to engage the perimeter channel, the perimeter skirt comprising a "J"-shaped hooking end and an elongated tail segment extending downwardly away from the hooking end.

16. The modular flooring platform as recited in claim 1, wherein the perimeter channel is adapted to engage at least one wall panel.

17. The modular flooring platform as recited in claim 1, wherein said at least one wall panel comprises a galvanized steel skin over a polyurethane core.

18. A modular flooring platform adapted for use in overlying relation to irregular terrain, the modular flooring platform comprising:

a plurality of elongate interior frame members, the interior frame members having a length and comprising a substantially hollow tubular body portion defining a hollow interior extending along the length of the interior frame members, the interior frame members each including a pair of lateral ledge elements defining substantially flat fins projecting away from opposing sides of the hollow tubular body portion at a common, defined elevation;

a plurality of elongate perimeter frame members, the perimeter frame members having a length and comprising a substantially hollow tubular body portion defining a hollow interior extending along the length of the interior frame members, the perimeter frame members each including an inboard lateral edge element defining a substantially flat fin projecting away from a first side of the hollow tubular body and a substantially L-shaped outboard lateral ledge element projecting away from a second side of the hollow tubular body to define a raised lip spaced apart from the hollow tubular body portion of the perimeter frame member, wherein the hollow tubular body portion of each perimeter frame member has substantially the same size and shape as the hollow tubular body portion of each interior frame member, and wherein the substantially flat fins on the interior frame members are disposed at substantially the same elevation as the inboard lateral edge elements and outboard lateral ledge elements on the perimeter frame members;

a plurality of angle-forming connection elements, each angle-forming connection element comprising a plurality of hollow tubular legs projecting away from an intersection, such that at least two of the hollow tubular legs are in angled relation to one another, wherein the hollow tubular legs are adapted to slide in telescoping relation into the hollow tubular body portions of the interior frame members and wherein a support plate surrounding an opening is positioned substantially at the intersection of each angle-forming connection element, the opening being adapted to receive an engagement stud on a leveling support, the interior frame members, perimeter frame members and angle-forming connection elements being connectable to form a grid frame having a discontinuous perimeter channel formed by the outboard lateral ledge elements and a plurality of interstices at least partially surrounded by interior frame members at locations inboard from the perimeter channel; and a plurality of removable floor panels adapted to fit in nested relation within the interstices to define a supporting flooring surface.

19. The modular flooring platform as recited in claim 18, wherein the perimeter channel is adapted to engage at least one wall panel.

20. The modular flooring platform as recited in claim 19, wherein said at least one wall panel comprises a galvanized steel skin over a polyurethane core.

* * * * *